US009017520B2

(12) United States Patent
Hayes

(10) Patent No.: US 9,017,520 B2
(45) Date of Patent: Apr. 28, 2015

(54) PAPER COATING OR BINDING FORMULATIONS AND METHODS OF MAKING AND USING SAME

(75) Inventor: Peter C. Hayes, Charlotte, NC (US)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 13/634,738

(22) PCT Filed: Mar. 21, 2011

(86) PCT No.: PCT/EP2011/054190

§ 371 (c)(1),
(2), (4) Date: Nov. 5, 2012

(87) PCT Pub. No.: WO2011/117169

PCT Pub. Date: Sep. 29, 2011

(65) Prior Publication Data

US 2013/0048240 A1 Feb. 28, 2013

Related U.S. Application Data

(60) Provisional application No. 61/316,488, filed on Mar. 23, 2010.

(51) Int. Cl.

| | |
|---|---|
| ***D21H 17/33*** | (2006.01) |
| ***D21H 17/37*** | (2006.01) |
| ***D21H 17/63*** | (2006.01) |
| ***D21H 21/18*** | (2006.01) |
| ***D21H 19/36*** | (2006.01) |
| ***D21H 19/56*** | (2006.01) |
| ***D21H 21/10*** | (2006.01) |

(52) U.S. Cl.

CPC ..... *D21H 19/56* (2013.01); *D21H 21/10* (2013.01)

(58) Field of Classification Search

USPC ..... 162/158, 168.1–168.3, 168.7, 169, 162/181.1–181.8, 183–185; 524/543, 555, 524/556, 560–6; 526/72, 310–12, 317.1, 526/333, 318.1–318.4, 319, 320, 328, 332, 526/328.5–330, 341, 342; 106/287.35, 402, 106/499

See application file for complete search history.

(56) References Cited

U.S. PATENT DOCUMENTS

| | | | | |
|---|---|---|---|---|
| 3,607,486 | A | 9/1971 | Jacks et al. | |
| 4,011,388 | A | 3/1977 | Murphy et al. | |
| 4,611,087 | A | 9/1986 | Yamashita et al. | |
| 4,686,254 | A | 8/1987 | Lochhead et al. | |
| 4,814,514 | A * | 3/1989 | Yokota et al. | 568/608 |
| 4,939,283 | A | 7/1990 | Yokota et al. | |
| 4,943,612 | A | 7/1990 | Morita et al. | |
| 4,952,650 | A | 8/1990 | Young et al. | |
| 5,133,898 | A | 7/1992 | Fock et al. | |
| 5,168,087 | A | 12/1992 | Li Bassi et al. | |
| 5,173,534 | A | 12/1992 | Biale | |
| 5,268,437 | A | 12/1993 | Holy et al. | |
| 5,273,676 | A | 12/1993 | Boeckh et al. | |
| 5,275,650 | A | 1/1994 | Mongoin et al. | |
| 5,332,854 | A | 7/1994 | Yokota et al. | |
| 5,338,485 | A | 8/1994 | Fock et al. | |
| 5,340,870 | A | 8/1994 | Clinnin et al. | |
| 5,380,784 | A | 1/1995 | Usiki et al. | |
| 5,389,722 | A | 2/1995 | Nagasuna et al. | |
| 5,414,041 | A | 5/1995 | Larson et al. | |
| 5,506,325 | A | 4/1996 | Swarup et al. | |
| 5,534,577 | A | 7/1996 | Namba et al. | |
| 5,637,142 | A | 6/1997 | Kubo et al. | |
| 5,661,206 | A | 8/1997 | Tanaka et al. | |
| 5,679,735 | A | 10/1997 | Geissler et al. | |
| 5,679,835 | A | 10/1997 | Inden et al. | |
| 5,707,445 | A | 1/1998 | Yamato et al. | |
| 5,721,330 | A | 2/1998 | Ma | |
| 5,726,268 | A | 3/1998 | Sakamoto | |
| 5,911,820 | A | 6/1999 | Satoh et al. | |
| 5,925,184 | A | 7/1999 | Hirata et al. | |
| 5,928,783 | A * | 7/1999 | Phan et al. | 428/355 EN |
| 5,962,571 | A | 10/1999 | Overbeek et al. | |
| 5,977,242 | A | 11/1999 | Origuchi et al. | |

(Continued)

FOREIGN PATENT DOCUMENTS

| | | |
|---|---|---|
| CA | 2180989 | 6/2003 |
| EP | 422120 | 4/1991 |

(Continued)

OTHER PUBLICATIONS

"New Reactive Surfactant: Adeka reasoap ER/SR Series," Technical Information Sheet, Asahi Denka Co., Ltd., Jan. 29, 2003, 4 pages.*

ADEKA Reasoap Material Safety Data Sheet, ADEKA Corp., revised Sep. 10, 2006, 7 pages.

Mayer, H., "Masonry Protection with Silanes, Siloxanes and Silicone Resins," Surface Coatings International, Jocca, vol. 81, No. 2, Feb. 1998, pp. 89-93.

Mizutani, Tsutomu, et al., "Preparation of Spherical Nanocomposites Consisting of Silica Core and Polyacrylate Shell by Emulsion Polymerization," Journal of Applied Polymer Science, vol. 99, 2006, pp. 659-669.

(Continued)

*Primary Examiner* — Dennis Cordray

(74) *Attorney, Agent, or Firm* — Meunier Carlin & Curfman, LLC

(57) ABSTRACT

Paper coating or binding formulations are provided that comprise aqueous copolymer emulsions including copolymers derived from one or more copolymerizable surfactants of formula I and one or more monomers. The paper coating or binding formulations can include one or more mineral fillers, coating pigments, or mixtures thereof, wherein the total weight concentration of the one or more mineral fillers, coating pigments, or mixtures thereof is 65% or higher, based on the total weight of the composition. Paper products coated with the paper coating or binding formulations, methods of making the paper coating or binding formulations, and methods of making the coated paper products are also disclosed.

15 Claims, No Drawings

(56) References Cited

U.S. PATENT DOCUMENTS

| | | | | |
|---|---|---|---|---|
| 6,005,042 | A | 12/1999 | Desor et al. | |
| 6,048,953 | A | 4/2000 | Kawashima et al. | |
| 6,087,418 | A | 7/2000 | Yamashita et al. | |
| 6,103,788 | A | 8/2000 | Harui et al. | |
| 6,140,435 | A | 10/2000 | Zanotti-Russo | |
| 6,156,860 | A | 12/2000 | Tanaka et al. | |
| 6,166,112 | A | 12/2000 | Hirata et al. | |
| 6,174,980 | B1 | 1/2001 | Hirata et al. | |
| 6,187,841 | B1 | 2/2001 | Tanaka et al. | |
| 6,201,089 | B1 | 3/2001 | Carter | |
| 6,214,958 | B1 | 4/2001 | Le-Khac et al. | |
| 6,225,389 | B1 | 5/2001 | Saint Victor | |
| 6,239,241 | B1 | 5/2001 | Yamato et al. | |
| 6,258,162 | B1 | 7/2001 | Kawakami et al. | |
| 6,264,739 | B1 | 7/2001 | Yamato et al. | |
| 6,265,495 | B1 | 7/2001 | Hirata et al. | |
| 6,271,326 | B1 | 8/2001 | Nishikawa et al. | |
| 6,294,015 | B1 | 9/2001 | Yamashita et al. | |
| 6,313,244 | B1 | 11/2001 | Tanaka et al. | |
| 6,326,446 | B2 | 12/2001 | Carter | |
| 6,329,461 | B1 * | 12/2001 | Akiyama et al. | 524/730 |
| 6,376,581 | B1 | 4/2002 | Tanaka et al. | |
| 6,384,168 | B1 | 5/2002 | Tanaka et al. | |
| 6,388,038 | B1 | 5/2002 | Hirata et al. | |
| 6,462,110 | B2 | 10/2002 | Satoh et al. | |
| 6,506,837 | B2 | 1/2003 | Destarac et al. | |
| 6,524,679 | B2 | 2/2003 | Hauber et al. | |
| 6,527,850 | B2 | 3/2003 | Schwartz et al. | |
| 6,534,590 | B1 | 3/2003 | Aso et al. | |
| 6,534,597 | B2 | 3/2003 | Adam et al. | |
| 6,538,047 | B1 | 3/2003 | Miyabayashi | |
| 6,545,083 | B1 | 4/2003 | Hirata et al. | |
| 6,555,641 | B2 | 4/2003 | Parker et al. | |
| 6,569,234 | B2 | 5/2003 | Yamashita et al. | |
| 6,569,976 | B2 | 5/2003 | Baxter et al. | |
| 6,593,412 | B1 | 7/2003 | Rabasco et al. | |
| 6,602,949 | B2 | 8/2003 | Furukawa et al. | |
| 6,624,243 | B2 | 9/2003 | Stark et al. | |
| 6,652,867 | B1 | 11/2003 | Vincent et al. | |
| 6,656,266 | B1 | 12/2003 | Barlet-Gouedard et al. | |
| 6,673,885 | B1 | 1/2004 | Shibata et al. | |
| 6,713,553 | B2 | 3/2004 | Gonnon et al. | |
| 6,716,943 | B2 | 4/2004 | Tanaka et al. | |
| 6,723,786 | B2 | 4/2004 | Husemann et al. | |
| 6,723,813 | B2 | 4/2004 | Asai et al. | |
| 6,727,315 | B2 | 4/2004 | Yamamoto et al. | |
| 6,737,493 | B2 | 5/2004 | Mochizuki et al. | |
| 6,743,834 | B2 | 6/2004 | Yokoyama et al. | |
| 6,770,354 | B2 | 8/2004 | Randall et al. | |
| 6,780,924 | B2 * | 8/2004 | Shih et al. | 524/555 |
| 6,815,513 | B2 | 11/2004 | Le-Khac et al. | |
| 6,841,655 | B1 * | 1/2005 | Gota et al. | 528/425 |
| 6,869,988 | B2 | 3/2005 | Schwartz et al. | |
| 6,878,321 | B2 | 4/2005 | Hauber et al. | |
| 6,900,275 | B2 | 5/2005 | Tomita et al. | |
| 6,905,814 | B1 | 6/2005 | Aubay et al. | |
| 6,919,388 | B2 | 7/2005 | Nishikawa et al. | |
| 6,921,801 | B2 | 7/2005 | Collette et al. | |
| 6,933,415 | B2 | 8/2005 | Zhao et al. | |
| 6,946,505 | B2 | 9/2005 | Yuasa et al. | |
| 6,960,624 | B2 | 11/2005 | Gonnon et al. | |
| 6,969,734 | B1 | 11/2005 | Pressley et al. | |
| 7,008,977 | B2 | 3/2006 | Sakai et al. | |
| 7,098,250 | B2 | 8/2006 | Sawada et al. | |
| 7,144,944 | B2 * | 12/2006 | Murase et al. | 524/501 |
| 7,217,443 | B2 * | 5/2007 | Bobsein et al. | 427/428.01 |
| 7,297,328 | B2 | 11/2007 | Löffler et al. | |
| 7,378,479 | B2 | 5/2008 | Tamareselvy et al. | |
| 7,393,888 | B2 | 7/2008 | Yoshimura | |
| 7,445,849 | B2 | 11/2008 | Apitz et al. | |
| 7,776,975 | B2 * | 8/2010 | Blankenship et al. | 526/82 |
| 7,893,131 | B2 | 2/2011 | Matthews et al. | |
| 7,989,545 | B2 * | 8/2011 | Farwaha et al. | 524/556 |
| 2002/0065208 | A1 | 5/2002 | Aubay et al. | |
| 2002/0103316 | A1 | 8/2002 | Tanaka et al. | |
| 2002/0123588 | A1 | 9/2002 | Adam et al. | |
| 2002/0157573 | A1 | 10/2002 | Pellett | |
| 2002/0168533 | A1 | 11/2002 | Taylor et al. | |
| 2003/0031719 | A1 | 2/2003 | Kipp et al. | |
| 2003/0162890 | A1 | 8/2003 | Kalantar et al. | |
| 2003/0212195 | A1 | 11/2003 | Matsumoto et al. | |
| 2004/0048963 | A1 | 3/2004 | Sawada et al. | |
| 2004/0052746 | A1 | 3/2004 | Tamareselvy et al. | |
| 2004/0054111 | A1 | 3/2004 | Kalantar et al. | |
| 2004/0075074 | A1 | 4/2004 | Kubota et al. | |
| 2004/0109836 | A1 | 6/2004 | Löffler et al. | |
| 2004/0127607 | A1 | 7/2004 | Schober et al. | |
| 2004/0152379 | A1 | 8/2004 | McLarty, III et al. | |
| 2004/0170873 | A1 | 9/2004 | Smith | |
| 2004/0185231 | A1 | 9/2004 | Dimmick | |
| 2004/0209074 | A1 | 10/2004 | Randall et al. | |
| 2004/0235687 | A1 | 11/2004 | Shiba et al. | |
| 2004/0242760 | A1 | 12/2004 | Shibai et al. | |
| 2005/0075416 | A1 | 4/2005 | Miyabayashi | |
| 2005/0202742 | A1 | 9/2005 | Smith et al. | |
| 2005/0202997 | A1 | 9/2005 | Hanazawa et al. | |
| 2005/0222301 | A1 | 10/2005 | Yuasa et al. | |
| 2005/0229519 | A1 | 10/2005 | Colbert et al. | |
| 2005/0250887 | A1 | 11/2005 | Yang et al. | |
| 2005/0266225 | A1 | 12/2005 | Currier et al. | |
| 2005/0266238 | A1 | 12/2005 | Amano et al. | |
| 2006/0024494 | A1 | 2/2006 | Amano et al. | |
| 2006/0035112 | A1 | 2/2006 | Veeramosuneni et al. | |
| 2006/0057371 | A1 | 3/2006 | Kobayashi et al. | |
| 2006/0115669 | A1 | 6/2006 | Shinohara et al. | |
| 2006/0178494 | A1 | 8/2006 | Pabon et al. | |
| 2006/0188714 | A1 | 8/2006 | Tetsumoto et al. | |
| 2006/0240236 | A1 | 10/2006 | Bland et al. | |
| 2006/0277854 | A1 | 12/2006 | Egan | |
| 2006/0278267 | A1 | 12/2006 | Miyazawa | |
| 2007/0012221 | A1 | 1/2007 | Maeta et al. | |
| 2007/0123637 | A1 | 5/2007 | Pernecker et al. | |
| 2007/0135559 | A1 | 6/2007 | Fukumon et al. | |
| 2007/0287019 | A1 | 12/2007 | Chen et al. | |
| 2008/0057346 | A1 | 3/2008 | Peuramaki | |
| 2008/0069793 | A1 | 3/2008 | Löffler et al. | |
| 2008/0245012 | A1 | 10/2008 | Boisvert et al. | |
| 2009/0043035 | A1 | 2/2009 | Cabrera | |
| 2010/0062264 | A1 * | 3/2010 | Hayes et al. | 428/432 |

FOREIGN PATENT DOCUMENTS

| | | |
|---|---|---|
| EP | 0725044 | 7/1996 |
| EP | 1369434 | 12/2003 |
| EP | 1712573 | 10/2006 |
| EP | 1911808 | 4/2008 |
| GB | 1242290 | 8/1971 |
| GB | 2264114 | 8/1993 |
| GB | 2319522 | 5/1998 |
| JP | 59203742 | 11/1984 |
| JP | 08217505 | 8/1996 |
| JP | 03218956 | 8/2001 |
| JP | 2009256481 | 11/2009 |
| WO | 97/11996 | 4/1997 |
| WO | 98/28240 | 7/1998 |
| WO | 00/22016 | 4/2000 |
| WO | 00/63294 | 10/2000 |
| WO | 02/12144 | 2/2002 |
| WO | 2010/026065 | 3/2010 |

OTHER PUBLICATIONS

NeoCAR® Acrylics 7657 and 7658, NeoCAR® Acrylics: The Next Step in Technology and Performance, Union Carbide, 1998, 16 pages.

Product Bulletin Vv 1.2, VeoVa™ Monomers Applications and Advantages, Hexion Specialty Chemicals, 2007, 4 pages.

Product Data Sheet, VeoVa™ Monomer 10, Resolution Performance Products, Re-issued Oct. 2002, 3 pages.

VeoVa™ Vinyl Esters, Hexion Specialty Chemicals, retrieved from http://www.hexion.com/Products/ProductLiterature.aspx?id=693 on May 26, 2008, 1 page.

(56) References Cited

OTHER PUBLICATIONS

Willenbacher, N., et al., "New Laboratory Test to Characterize Immobilization and Dewatering of Paper Coating Colors," TAPPI Journal, vol. 82, No. 8, 1999, pp. 167-174.
Related U.S. Appl. No. 12/205,177, filed Sep. 5, 2008.
International Preliminary Report on Patentability and Written Opinion, dated Mar. 8, 2011, in related International Application No. PCT/EP2009/060850.
International Search Report, dated Feb. 24, 2010, in related International Application No. PCT/EP2009/060850.
International Preliminary Report on Patentability and Written Opinion, dated Sep. 25, 2012, in corresponding International Application No. PCT/EP2011/054190.
International Preliminary Report on Patentability and Written Opinion, dated Jul. 7, 2011, in corresponding International Application No. PCT/EP2011/054190.

* cited by examiner

PAPER COATING OR BINDING FORMULATIONS AND METHODS OF MAKING AND USING SAME

TECHNICAL FIELD

This disclosure relates to paper coating or binding formulations, and more particularly to copolymer emulsions and methods of making same for use in paper coating or binding formulations.

BACKGROUND

Paper typically includes binders and/or coatings to improve its optical and printing properties. For example, synthetic latexes can be used as components of pigmented coatings to increase the strength and the printability of the paper. For pigmented paper coating formulations, the solids content can influence the runnability of the coatings in the paper coating machine by affecting the viscosity of the coatings and their flow behavior at varying stresses in the coating machine. High solids content may be desired to save drying energy and to improve coating holdout for better printing quality. High water retention capacity may also be desired so as to prevent significant dewatering between the application and metering process steps.

When a paper coating formulation having a synthetic latex is subjected to high shear, such as, for example, in a blade coater, the formulation can exhibit a shear thinning or shear thickening behavior. Decreasing the solids content in the coating formulation may reduce shear thickening thereby improving the runnability of the formulation, but the quality of the resulting coating can be adversely affected by lower solids content and may also lead to excess absorption of water into the paper substrate, resulting in higher instances of web breaks.

Paper coating formulations that can be run at increasingly higher solids content can facilitate the production of high quality paper, increase production rates, and reduce energy costs. Conventional synthetic latexes may be limited in their use as paper coatings with high solids content due to the resulting high viscosity of the coating formulations at high shear rates.

SUMMARY

Paper coating or binding formulations are provided that comprise aqueous copolymer emulsions including copolymers derived from one or more copolymerizable surfactants and one The one or more copolymerizable surfactants can be of formula I:

(I)

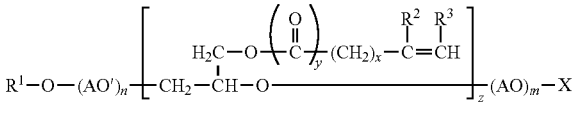

wherein $R^1$ represents a branched aliphatic hydrocarbon group, a secondary aliphatic hydrocarbon group or a branched aliphatic acyl group, AO and AO' each independently represents an oxyalkylene group having 2 to 4 carbon atoms, $R^2$ and $R^3$ each independently represents a hydrogen atom or a methyl group, x stands for a number of from 0 to 12, y stands for a number of 0 to 1, z stands for a number of from 1 to 10, X represents a hydrogen atom or an ionic hydrophilic group, m stands for a number of from 0 to 1,000, and n stands for a number of from 0 to 1,000.

In some embodiments, the copolymerizable surfactants can include at least one copolymerizable surfactant of formula Ia:

(Ia)

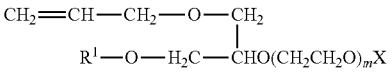

wherein $R^1$ is C9-C15 alkyl or C7-C11 alkyl-phenyl, X is H, $SO_3NH_4$ and/or $SO_3Na$, and m is 3 to 50. In some embodiments, $R^1$ is C10-C14 alkyl, X is H and/or $SO_3NH_4$, and m is 5 to 40.

The copolymers can be pure acrylic copolymers, styrene acrylic copolymers, styrene butadiene copolymers, or vinyl acrylic copolymers.

Also provided are paper products comprising a fiber matrix coated with a paper coating or binding formulation described herein.

Also provided are methods of making the paper coating or binding formulations described herein, comprising reacting monomers with at least one copolymerizable surfactant of formula I or salt thereof to form a copolymer in an aqueous dispersion and mixing the copolymer dispersion with one or more fillers including pigment and/or mineral.

Also provided are methods of making paper, comprising coating a fiber matrix with a paper coating or binding formulation described herein followed by drying to produce the paper.

The details of one or more embodiments are set forth in the description below. Other features, objects, and advantages will be apparent from the description and from the claims.

DETAILED DESCRIPTION

The term "comprising" and variations thereof as used herein are open, non-limiting terms. The term "including" and variations thereof as used herein mean "comprising" and variations thereof. The term "paper" as used herein includes free sheet, paperboard, cardboard, and the like.

A paper coating or binding formulation comprises an aqueous copolymer emulsion in which the copolymer is derived from one or more copolymerizable surfactants and one or more monomers. The paper coating or binding formulation can also include one or more mineral fillers, coating pigments, or mixtures thereof. The emulsion copolymer exhibits slower ink setting thereby providing higher print strength. As such, reduced copolymer levels can be used in the paper coating or binding formulation. In addition, the emulsion copolymer also has improved water retention properties and provides longer immobilization times. As such, reduced thickener levels and higher solids content can be used in the paper coating or binding formulation. The paper coating or binding formulation described herein has high solids content with high water retention. The paper coating or binding formulation also exhibits good runnability during application, high sheet gloss when applied to paper, high ink gloss after inking of paper, high ink receptivity when applied to paper, and/or good binding strength. It was surprising and unexpected that the copolymers when used in paper coating and/or binding formulations would provide increased immobilization times, reduced dewatering, and increased strength in the finished paper.

As mentioned above, the copolymer emulsion used in the coating or binding formulation is derived from one or more copolymerizable surfactants and one or more monomers. Copolymerizable surfactants suitable for use in the paper coating or binding formulation can have the formula I:

(I)

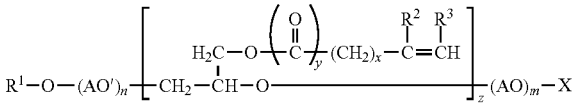

wherein $R^1$ represents a branched aliphatic hydrocarbon group, a secondary aliphatic hydrocarbon group or a branched aliphatic acyl group, AO and AO' each independently represents an oxyalkylene group having 2 to 4 carbon atoms, $R^2$ and $R^3$ each independently represents a hydrogen atom or a methyl group, x stands for a number of from 0 to 12, y stands for a number of 0 to 1, z stands for a number of from 1 to 10, X represents a hydrogen atom or an ionic hydrophilic group, m stands for a number of from 0 to 1,000, and n stands for a number of from 0 to 1,000. Suitable copolymerizable surfactants are described in U.S. Pat. No. 6,841,655, which is hereby incorporated by reference in its entirety.

In some embodiments, the copolymerizable surfactants can be provided according to Formula Ia:

(Ia)

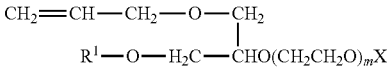

wherein $R^1$ is C9-C15 alkyl or C7-C11 alkyl-phenyl, X is H, $SO_3NH_4$ and/or $SO_3Na$, and m is 3 to 50. In some embodiments, $R^1$ is C10-C14 alkyl, X is H and/or $SO_3NH_4$, and m is 5 to 40. In some embodiments, m is 5 to 25, 5 to 20, or 5 to 15 (e.g., m=10). Exemplary copolymerizable surfactants wherein $R^1$ is C10-C14 alkyl can include ADEKA REASOAP series ER and SR surfactants (Asahi Denka Co., Ltd.), such as ER-10, ER-20, ER-30, ER-40, SR-10, SR-20, and SR-1025. For example, ADEKA REASOAP SR-10, which includes ammonium salts of poly(oxy-1,2-ethanediyl),alpha-sulfo-omega-[1-(hydroxymethyl)-2-(2-propenyloxy) ethoxy]-, C11-rich, C10-14-branched alkyl ethers, can be used. Exemplary copolymerizable surfactants in which $R^1$ is C7-C11 alkyl-phenyl can include ADEKA REASOAP series NE and SE surfactants, such as NE-10, NE-20, NE-30, NE-40, NE-50, SE-10N, SE-20N, and SE-1025N.

In some embodiments, the amount of copolymerizable surfactants present in the copolymer can range from 0.5 to 5, or 1 to 4, parts by weight per one hundred parts monomer ("phm").

Monomers suitable for use in the paper coating or binding formulation can generally be ethylenically unsaturated monomers including styrene, butadiene, vinyl acetate, carboxylic acids, (meth)acrylic acid esters, (meth)acrylamide, and (meth)acrylonitrile. For example, suitable monomers can include vinylaromatic compounds (e.g., styrene, α-methylstyrene, o-chlorostyrene, and vinyltoluenes); 1,2-butadiene (i.e., butadiene); conjugated dienes (e.g., 1,3-butadiene and isoprene); α,β-monoethylenically unsaturated mono- and dicarboxylic acids or anhydrides thereof (e.g., acrylic acid, methacrylic acid, crotonic acid, dimethacrylic acid, ethylacrylic acid, allylacetic acid, vinylacetic acid maleic acid, fumaric acid, itaconic acid, mesaconic acid, methylenemalonic acid, citraconic acid, maleic anhydride, itaconic anhydride, and methylmalonic anhydride); esters of α,β-monoethylenically unsaturated mono- and dicarboxylic acids having 3 to 6 carbon atoms with alkanols having 1 to 12 carbon atoms (e.g., esters of acrylic acid, methacrylic acid, maleic acid, fumaric acid, or itaconic acid, with C1-C12, C1-C8, or C1-C4 alkanols such as ethyl, n-butyl, isobutyl and 2-ethylhexyl acrylates and methacrylates, dimethyl maleate and n-butyl maleate); acrylamides and alkyl-substituted acrylamides (e.g., (meth)acrylamide, N-tert-butylacrylamide, and N-methyl(meth)acrylamide); (meth)acrylonitrile; vinyl and vinylidene halides (e.g., vinyl chloride and vinylidene chloride); vinyl esters of C1-C18 mono- or dicarboxylic acids (e.g., vinyl acetate, vinyl propionate, vinyl n-butyrate, vinyl laurate and vinyl stearate); C1-C4 hydroxyalkyl esters of C3-C6 mono- or dicarboxylic acids, especially of acrylic acid, methacrylic acid or maleic acid, or their derivatives alkoxylated with from 2 to 50 moles of ethylene oxide, propylene oxide, butylene oxide or mixtures thereof, or esters of these acids with C1-C18 alcohols alkoxylated with from 2 to 50 mol of ethylene oxide, propylene oxide, butylene oxide or mixtures thereof (e.g., hydroxyethyl(meth)acrylate, hydroxypropyl(meth)acrylate, and methylpolyglycol acrylate); and monomers containing glycidyl groups (e.g., glycidyl methacrylate).

Additional monomers suitable for use in the paper coating or binding formulation can include linear 1-olefins, branched-chain 1-olefins or cyclic olefins (e.g., ethene, propene, butene, isobutene, pentene, cyclopentene, hexene, and cyclohexene); vinyl and allyl alkyl ethers having 1 to 40 carbon atoms in the alkyl radical, wherein the alkyl radical can possibly carry further substituents such as a hydroxyl group, an amino or dialkylamino group, or one or more alkoxylated groups (e.g., methyl vinyl ether, ethyl vinyl ether, propyl vinyl ether, isobutyl vinyl ether, 2-ethylhexyl vinyl ether, vinyl cyclohexyl ether, vinyl 4-hydroxybutyl ether, decyl vinyl ether, dodecyl vinyl ether, octadecyl vinyl ether, 2-(diethylamino)ethyl vinyl ether, 2-(di-n-butylamino)ethyl vinyl ether, methyldiglycol vinyl ether, and the corresponding allyl ethers); sulfo-functional monomers (e.g., allylsulfonic acid, methallylsulfonic acid, styrenesulfonate, vinylsulfonic acid, allyloxybenzenesulfonic acid, 2-acrylamido-2-methylpropanesulfonic acid, and their corresponding alkali metal or ammonium salts, sulfopropyl acrylate and sulfopropyl methacrylate); vinylphosphonic acid, dimethyl vinylphosphonate, and other phosphorus monomers; alkylaminoalkyl(meth) acrylates or alkylaminoalkyl(meth)acrylamides or quaternization products thereof (e.g., 2-(N,N-dimethylamino)ethyl (meth)acrylate, 3-(N,N-dimethylamino)propyl(meth) acrylate, 2-(N,N,N-trimethylammonium)ethyl(meth) acrylate chloride, 2-dimethylaminoethyl(meth)acrylamide, 3-dimethylaminopropyl(meth)acrylamide, and 3-trimethylammoniumpropyl(meth)acrylamide chloride); allyl esters of C1-C30 monocarboxylic acids; N-Vinyl compounds (e.g., N-vinylformamide, N-vinyl-N-methylformamide, N-vinylpyrrolidone, N-vinylimidazole, 1-vinyl-2-methylimidazole, 1-vinyl-2-methylimidazoline, N-vinylcaprolactam, vinylcarbazole, 2-vinylpyridine, and 4-vinylpyridine); monomers containing 1,3-diketo groups (e.g., acetoacetoxyethyl(meth)acrylate or diacetonacrylamide; monomers containing urea groups (e.g., ureidoethyl(meth)acrylate, acrylamidoglycolic acid, and methacrylamidoglycolate methyl ether); and monomers containing silyl groups (e.g., trimethoxysilylpropyl methacrylate).

Suitable monomers can also include one or more crosslinkers such as N-alkylolamides of α,β-monoethylenically unsaturated carboxylic acids having 3 to 10 carbon atoms and esters thereof with alcohols having 1 to 4 carbon atoms (e.g., N-methylolacrylamide and N-methylolmethacrylamide); glyoxal based crosslinkers; monomers containing two vinyl radicals; monomers containing two vinylidene radicals; and monomers containing two alkenyl radicals. Exemplary crosslinking monomers can include diesters of dihydric alcohols with α,β-monoethylenically unsaturated monocarboxylic acids, of which in turn acrylic acid and methacrylic acid can be employed. Examples of such monomers containing two non-conjugated ethylenically unsaturated double bonds can include alkylene glycol diacrylates and dimethacrylates, such as ethylene glycol diacrylate, 1,3-butylene glycol diacrylate, 1,4-butylene glycol diacrylate and propylene glycol diacrylate, divinylbenzene, vinyl methacrylate, vinyl acrylate, allyl methacrylate, allyl acrylate, diallyl maleate, diallyl fumarate and methylenebisacrylamide. In some embodiments, the crosslinking monomers can include alkylene glycol diacrylates and dimethacrylates, and/or divinylbenzene. The crosslinking monomers when used in the copolymer can be present in an amount of from 0.2 to 5 phm and are considered part of the total amount of monomers used in the copolymer.

In addition to the crosslinking monomers, small amounts (e.g., from 0.01 to 4 phm) of molecular weight regulators, such as tert-dodecyl mercaptan, can be used. Such regulators can be added to the polymerization zone in a mixture with the monomers to be polymerized and are considered part of the total amount of monomers used in the copolymer.

In some embodiments, the monomers can include styrene, α-methylstyrene, (meth)acrylic acid, itaconic acid, maleic acid, fumaric acid, crotonic acid, methyl(meth)acrylate, ethyl (meth)acrylate, n-butyl(meth)acrylate, isobutyl(meth)acrylate, tert-butyl(meth)acrylate, 2-ethylhexyl(meth)acrylate, vinyl acetate, butadiene, (meth)acrylamide, (meth)acrylonitrile, hydroxyethyl(meth)acrylate and glycidyl(meth)acrylate.

The copolymer can be a pure acrylic copolymer, a styrene acrylic copolymer, a styrene butadiene copolymer, or a vinyl acrylic copolymer.

In some embodiments, the copolymer can be a pure acrylic copolymer derived from one or more monomers chosen from (meth)acrylic acid, (meth)acrylic acid esters, (meth)acrylamide, and (meth)acrylonitrile. In some embodiments, the copolymer can include from 71 to 99.5 phm of at least one (meth)acrylic acid ester, from 0.5 to 5 phm of at least one copolymerizable surfactant of Formula I, from 0 to 6 phm of itaconic acid and/or (meth)acrylic acid, from 0 to 3 phm of at least one (meth)acrylamide, from 0 to 20 phm of at least one (meth)acrylonitrile, and from 0 to 5 phm of vinyl triethoxysilane.

In some embodiments, the copolymer can be a copolymer of methyl methacrylate ("MMA"), n-butyl acrylate ("BA"), and at least one copolymerizable surfactant of Formula I (e.g., a surfactant of Formula Ia). In some embodiments, the copolymer can include from 25 to 85 phm of MMA, from 20 to 65 phm of BA, from 0.5 to 5 phm of at least one copolymerizable surfactant of Formula I, from 0 to 6 phm of itaconic and/or (meth)acrylic acid, from 0 to 3 phm of at least one (meth)acrylamide, from 0 to 20 phm of at least one (meth) acrylonitrile, and from 0 to 5 phm of vinyl triethoxysilane.

In some embodiments, the copolymer can be a copolymer of MMA, 2-ethyl hexyl acrylate ("2-EHA"), and at least one copolymerizable surfactant of Formula I (e.g., a surfactant of Formula Ia). In some embodiments, the copolymer can include from 25 to 85 phm of MMA, from 20 to 65 phm of 2-EHA, from 0.5 to 5 phm of at least one copolymerizable surfactant of Formula I, from 0 to 6 phm of itaconic and/or (meth)acrylic acid, from 0 to 3 phm of at least one (meth) acrylamide, from 0 to 20 phm of at least one (meth)acrylonitrile, and from 0 to 5 phm of vinyl triethoxysilane.

In some embodiments, the copolymer can be a copolymer of 2-EHA, BA, and at least one copolymerizable surfactant of Formula I (e.g., a surfactant of Formula Ia). In some embodiments, the copolymer can include from 20 to 65 phm of 2-EHA, from 20 to 65 phm of BA, from 0.5 to 5 phm of at least one copolymerizable surfactant of Formula I, from 0 to 6 phm of itaconic and/or (meth)acrylic acid, from 0 to 3 phm of at least one (meth)acrylamide, from 0 to 20 phm of at least one (meth)acrylonitrile, and from 0 to 5 phm of vinyl triethoxysilane.

In some embodiments, the copolymer can be a styrene acrylic copolymer derived from monomers including styrene, (meth)acrylic acid, (meth)acrylic acid esters, (meth)acrylamide, (meth)acrylonitrile, and mixtures thereof. For example, the styrene acrylic copolymer can include styrene and at least one of (meth)acrylic acid, itaconic acid, methyl(meth)acrylate, ethyl(meth)acrylate, n-butyl(meth)acrylate, isobutyl (meth)acrylate, tert-butyl(meth)acrylate, 2-ethylhexyl(meth) acrylate, (meth)acrylamide, (meth)acrylonitrile, and hydroxyethyl(meth)acrylate. The styrene acrylic copolymer can include from 24 to 87 phm of (meth)acrylates, from 18 to 81 phm of styrene, from 0.5 to 5 phm of at least one copolymerizable surfactant of Formula I, from 0 to 2 phm of (meth) acrylamide, and from 0 to 20 phm of (meth)acrylonitrile. The styrene acrylic copolymer can also include from 0 to 3 phm of one or more crosslinking monomers as described above such as alkylene glycol diacrylates and dimethacrylates.

In some embodiments, the copolymer can be a styrene butadiene copolymer derived from monomers including styrene, butadiene, (meth)acrylamide, (meth)acrylonitrile, itaconic acid and (meth)acrylic acid. The styrene butadiene copolymer can include from 25 to 95 phm of styrene, from 15 to 90 phm of butadiene, from 0.5 to 5 phm of at least one copolymerizable surfactant of Formula I, from 0 to 6 phm of itaconic and/or (meth)acrylic acid, from 0 to 2 phm of (meth) acrylamide, and from 0 to 20 phm of (meth)acrylonitrile. The styrene butadiene copolymer can also include from 0 to 3 phm of one or more crosslinking monomers as described above such as divinylbenzene.

In some embodiments, the copolymer can be a vinyl acrylic copolymer derived from monomers including vinyl acetate, (meth)acrylic acid, (meth)acrylic acid esters, (meth)acrylamide, (meth)acrylonitrile, and mixtures thereof. For example, the vinyl acrylic copolymer can include vinyl acetate and at least one of (meth)acrylic acid, itaconic acid, methyl(meth) acrylate, ethyl(meth)acrylate, n-butyl(meth)acrylate, isobutyl(meth)acrylate, tert-butyl(meth)acrylate, 2-ethylhexyl (meth)acrylate, (meth)acrylamide, (meth)acrylonitrile, and hydroxyethyl(meth)acrylate. The vinyl acrylic copolymer can include from 24 to 87 phm of (meth)acrylates, from 18 to 81 phm of vinyl acetate, from 0.5 to 5 phm of at least one copolymerizable surfactant of Formula I, from 0 to 2 phm of (meth)acrylamide, and from 0 to 20 phm of (meth)acrylonitrile. The vinyl acrylic copolymer can also include from 0 to 3 phm of one or more crosslinking monomers as described above such as alkylene glycol diacrylates and dimethacrylates.

The choice of the monomers in addition to the copolymerizable surfactants used in the copolymer can be driven by economic concerns, for example, to decrease the cost of producing the paper coating or binding formulation. The choice of the monomers can also be driven by the characteristics of the monomers and the requirements of the end applications, for example, to resist water and/or light. In some embodiments, the monomers and the amounts that the monomers are used to form the copolymer are selected to provide a glass transition temperature ("Tg") of the copolymer that from −10° C. to 25° C.

In some embodiments, the copolymer emulsion can be substantially free of non-copolymerizable surfactants. "Substantially free" means that to the extent the copolymer emulsion contains non-copolymerizable surfactants, the amount does not reduce the ink setting performance and/or the water retention property of the emulsion. For example, the copolymer emulsion can include less than 0.1 phm, less than 0.05 phm, or less than 0.01 phm of non-copolymerizable surfactants. In some embodiments, the copolymer emulsion is free of non-copolymerizable surfactants.

The copolymer emulsion can be prepared by polymerizing the monomers (including the copolymerizable surfactant) using free-radical aqueous emulsion polymerization. The emulsion polymerization temperature is generally from 30 to 95° C. or from 75 to 90° C. The polymerization medium can include water alone or a mixture of water and water-miscible liquids, such as methanol. In some embodiments, water is used alone. The emulsion polymerization can be carried out either as a batch, semi-batch or continuous process. Typically, a semi-batch process is used. In some embodiments, a portion of the monomers can be heated to the polymerization temperature and partially polymerized, and the remainder of the polymerization batch can be subsequently fed to the polymerization zone continuously, in steps or with superposition of a concentration gradient. In some embodiments, the copolymerizable surfactant to be used can be provided initially in the polymerization zone in dissolved form in an aqueous mixture.

The free-radical emulsion polymerization can be carried out in the presence of a free-radical polymerization initiator. The free-radical polymerization initiators that can be used in the process are all those which are capable of initiating a free-radical aqueous emulsion polymerization including alkali metal peroxydisulfates and $H_2O_2$, or azo compounds. Combined systems can also be used comprising at least one organic reducing agent and at least one peroxide and/or hydroperoxide, e.g., tert-butyl hydroperoxide and the sodium metal salt of hydroxymethanesulfinic acid or hydrogen peroxide and ascorbic acid. Combined systems can also be used additionally containing a small amount of a metal compound which is soluble in the polymerization medium and whose metallic component can exist in more than one oxidation state, e.g., ascorbic acid/iron(II) sulfate/hydrogen peroxide, where ascorbic acid can be replaced by the sodium metal salt of hydroxymethanesulfinic acid, sodium sulfite, sodium hydrogen sulfite or sodium metal bisulfite and hydrogen peroxide can be replaced by tert-butyl hydroperoxide or alkali metal peroxydisulfates and/or ammonium peroxydisulfates. In general, the amount of free-radical initiator systems employed can be from 0.1 to 2 phm, based on the total amount of the monomers to be polymerized. In some embodiments, the initiators are ammonium and/or alkali metal peroxydisulfates (e.g., sodium peroxydisulfates), alone or as a constituent of combined systems. The manner in which the free-radical initiator system is added to the polymerization reactor during the free-radical aqueous emulsion polymerization is not critical. It can either all be introduced into the polymerization reactor at the beginning, or added continuously or stepwise as it is consumed during the free-radical aqueous emulsion polymerization. In detail, this depends in a manner known to an average person skilled in the art both from the chemical nature of the initiator system and on the polymerization temperature. In some embodiments, some is introduced at the beginning and the remainder is added to the polymerization zone as it is consumed. It is also possible to carry out the free-radical aqueous emulsion polymerization under superatmospheric or reduced pressure.

The copolymer emulsion can include, as a disperse phase, particles of the copolymer dispersed in water. The copolymer emulsion can be prepared with a total solids content of from 10 to 75% by weight, 15 to 65% by weight, or 20 to 60% by weight. The copolymer dispersion can then be concentrated if desired to provide a total solids content of 40-75% by weight. The copolymer particles can have a median particle size of from 80 nm to 160 nm, or from 90 nm to 150 nm. The copolymer emulsion can be converted, in a manner known per se, to redispersible copolymer powders (e.g., spray drying, roll drying or suction-filter drying). If the copolymer dispersion is to be dried, drying aids can be used with the dispersion. The copolymer may have a long shelf life and can be redispersed in water for use in the paper coating or binding formulation.

The paper coating or binding formulation described herein can include one or more mineral fillers and/or coating pigments. Mineral fillers generally have a substantial proportion of particles having a particle size greater than 2 microns whereas coating pigments have a substantial proportion of particles having a particle size less than 2 microns. In some embodiments, the mineral fillers and/or coating pigments can be added to impart certain properties to a paper such as smoothness, whiteness, increased density or weight, decreased porosity, increased opacity, flatness, glossiness, and the like. The mineral fillers and/or coating pigments can include calcium carbonate (precipitated or ground), kaolin, clay, talc, diatomaceous earth, mica, barium sulfate, magnesium carbonate, vermiculite, graphite, carbon black, alumina, silicas (fumed or precipitated in powders or dispersions), colloidal silica, silica gel, titanium oxides, aluminum hydroxide, aluminum trihydrate, satine white, and magnesium oxide. The formulation can include exclusively mineral fillers or coating pigments but generally includes a blend of mineral fillers and coating pigments (e.g. weight ratios of 90:10, 80:20, 70:30, 60:40, 50:50, 40:60, 30:70, 20:80 or 10:90). Exemplary coating pigments include MIRAGLOSS 91 (a kaolin clay coating pigment commercially available from BASF Corporation) and HYDROCARB 90 (a calcium carbonate coating pigment commercially available from Omya Paper). An exemplary mineral filler is a calcium carbonate mineral filler such as DF 50 from Franklin Industrial Minerals.

In some embodiments, the formulation can include non-toxic anticorrosive pigments. Examples of such anticorrosive pigments include phosphate-type anticorrosive pigments such as zinc phosphate, calcium phosphate, aluminum phosphate, titanium phosphate, silicon phosphate, and ortho- and fused-phosphates thereof.

In some embodiments, the formulation can include one or more dyes and/or colored pigments to produce a colored or patterned paper or to change the shade of the paper. Exemplary dyes can include basic dyes, acid dyes, anionic direct dyes, and cationic direct dyes. Exemplary colored pigments include organic pigments and inorganic pigments in the form of anionic pigment dispersions and cationic pigment dispersions.

In some embodiments, one or more thickeners (rheology modifiers) can be added to increase the viscosity of the paper coating or binding formulation. Suitable thickeners can acrylic copolymer dispersions sold under the STEROCOLL and LATEKOLL trademarks from BASF Corporation, Florham Park, N.J., hydroxyethyl cellulose, guar gum, jaguar, carrageenan, xanthan, acetan, konjac mannan, xyloglucan, urethanes and mixtures thereof. The thickeners can be added to the paper coating or binding formulation as an aqueous dispersion or emulsion, or as a solid powder. Exemplary dispersants can include sodium polyacrylates in aqueous solution such as those sold under the DARVAN trademark by R.T. Vanderbilt Co., Norwalk, Conn.

The paper coating or binding formulation described herein can include additives such as thickeners, dispersants, initiators, stabilizers, chain transfer agents, buffering agents, salts, preservatives, fire retardants, wetting agents, protective colloids, biocides, corrosion inhibitors, crosslinkers, crosslinking promoters, and lubricants.

The paper binding or coating composition described herein can include greater than 50 wt % solids, 55 to 75 wt % solids, or 60 to 70 wt % solids. The one or more mineral fillers and/or coating pigments can be present in an amount greater than 65 wt %, 70 wt %, 80 wt %, or 90 wt % of the paper coating or binding formulation. For example, the one or more mineral fillers and/or coating pigments can be present in an amount of 70 to 98 wt %, 80 to 95 wt %, or 85 to 90 wt % of the total volume of the formulation. The copolymer can be present in an amount of 2 to 12 wt %, 4 to 10 wt %, or 6 to 9 wt % of the solid content. A thickener can be present in an amount of 0 to 5 wt %, greater than 0 to 3 wt %, or greater than 0 to 1 wt % of the solid content. Anticorrosive pigments, dyes and colored pigments can be present in an amount of 0 to 3 wt %, 0 to 2 wt %, or 0 to 1 wt % of the solid content. Other additives can be present in an amount of 0 to 5 wt %, 0 to 3 wt %, or 0 to 1 wt % of the solid content.

When used as a binder in a paper coating or binding formulation, the copolymer emulsion can impart one or more of water resistance, weather resistance, mold resistance, or low water absorption to the paper compared to applications that do not include the paper coating or binding formulations. In some embodiments, the copolymer emulsion can provide improvements in rheology of the paper coating or binding formulation. In some embodiments, the copolymer emulsion can provide an absence of dilatency to the paper coating or binding formulation. In some embodiments, the copolymer emulsion can provide improved filler acceptance for the paper coating or binding formulation.

In some embodiments, the paper coating or binding formulations described herein can have a water retention capacity (AAGWR at 2 ATMs for 2 minutes) of 100 g/m$^2$ or less, 90 g/m$^2$ or less, or 80 g/m$^2$ or less, when the formulation is applied to paper.

In some embodiments, the paper coating or binding formulations described herein can have an immobilization time of 300 sec or longer, 400 sec or longer, 500 sec or longer, or 600 sec or longer, as measured according to the method described in N. Willenbacher, et al., "New Laboratory Test to Characterize Immobilization and Dewatering of Paper Coating Colors" TAPPI Journal 82(8), 1999, pp 167-174.

The paper coating or binding formulation can be applied to a paper as a coating. If the formulation is provided as a coating, the formulation can be applied using any known method in the art such as roll coating, blade coating, or metered size press. The paper coating or binding formulation can be provided in an amount of 7-20 g/m$^2$ per 150 g/m$^2$ of paper. In some embodiments, the formulation can be applied in an amount of less than 15% by weight or 4 to 12% by weight based on the weight of the coated paper.

The resulting paper such as paper sheet, paperboard and cardboard comprises a fiber matrix and a binder composition comprising a copolymer obtained by polymerization of one or more copolymerizable surfactants and one or more monomers as described above. The binder can be provided as a coating layer on a paper substrate. The paper substrate that is coated with the paper coating or binding formulation can be any paper substrate including, but not limited to paper, paper board and cardboard. The formulation can be used with any type of paper coating process such as rotogravure, sheet offset, web offset, and flexographic processes.

Procedures

The test procedures for the present application were conducted as follows.

1. Brookfield Viscosity—measured according to TAPPI test method T648 om-97 using spindle #6 at 100 rpm.
2. Hercules Viscosity—measured according to TAPPI test method T648 om-97.
3. AA-GWR—measured according to TAPPI test method T701 pm-01.
4. IGT—measured according to TAPPI test method T499 wd-85.
5. Sheet gloss—measured according to TAPPI test method T480 om-99.
6. Immobilization Time—measured according to the procedure below:

a. Turn on computer (with program TEK 180/MCR) and Physica MCR 300 Rheometer.
b. Place measuring spindle on Physica MCR 300 Rheometer and lock collar in place.
c. Install paper for testing (precut paper to correct size 50 mm diameter). Engage vacuum before clamping in place to ensure a good fit. Place clamp in place and lock down.
d. Start the program by clicking on the start up icon on the computer.
e. Click the "Set up Measuring Device" icon at the top of the screen.
f. If the rheometer was previously powered off, click the "Initialization" button to start the rheometer.
g. With vacuum pump on (400-500 mB) and air pressure at minimum 50 psig, continue the set up.
h. Insure standard conditions for the measurement: standard gap setting at 0.2 mm or 0.0078" (for starch containing samples use a gap setting of 0.1 mm); gap range 0.1 to 0.3 mm; standard spindle torque setting 300 Pa (dynes/cm); torque range 10-500 Pa; and no vibration during testing).
i. Click the "Zero Gap" button. When the viscometer LCD screen indicates status "OK", the gap is set.
j. Turn off the vacuum.
k. Click "Lift position" and click "Cancel" when finished (instrument is in the up position) and "OK" at bottom of screen.
l. Open workbook by going to "File", "Open", and "Workbook", highlighting the workbook you want and double click (these are .CTX extension files). Then go to "File", then "DataPool", then "New".
m. Click yellow arrow at top of screen and input relevant information, check box beside "With Test Preparation." At bottom of screen click the "Prepare" button.
n. Add 1.5 ml of coating directly on the surface of the paper. Do not have the vacuum on at this point.
o. A new screen will come up with Continue Test, click "YES".

p. A new screen will come up with Position at Start, click "START". Give the spindle a gentle push to manually start its rotation, which will evenly distribute the coating under the spindle head.

q. When the gap equals 0.2 mm, start vacuum pump manually.

r. The testing progress can be viewed by clicking on the "Diagram" button at the bottom of the screen.

s. Click the yellow stop sign at the top of the screen when the immobilization point has been reached. The immobilization point is when the coating is no longer fluid and the curve on the graph becomes vertical. Measurements in excess of 700 seconds are outside the scope of this test. The purpose of this test is to determine the dynamic water retention. Drying of the coating edge and around the top surface of the spindle will result in erroneous data.

t. Remove spindle and clean. Unlock collar on spindle shaft first then press "Lift Position" to raise spindle for removal and cleaning.

u. Repeat above steps for next sample in series.

v. When testing is complete go to the top of the screen and repeat above steps for next sample in series.

w. At end of series testing go to "File", then "DataPool", then "Save As". This will save this DataPool of information as an .MPH file extension in the workbook chosen.

7. Prufbau passes to fail—measured according to the procedure below.

a. Prepare the sample (paper or paperboard) by allowing it to condition for 24 hours at 72° F.±5° F. and a relative humidity of 50%±5%.

b. Cut samples to measure approximately 240 mm+2 mm by 47+0.5 mm. If the sample is too wide, it may interfere with the run through the apparatus. If the sample is too narrow, it may result in the sample running off sideways, or askew.

c. Place the sample under clip located at the end of the sample carrier and fold sample back 180° so that it lies flat and parallel on the carrier with the side to be tested uppermost. Secure the free end with tape. Do not allow fingerprints to contaminate the portion of the sample to be tested.

d. The mounted sample is placed in the track before the printing station (multipurpose print test machine—system Dr. Druner—Prufbau) and a 4 cm wide aluminum printing disc installed. The carrier should have the clip to the rear, so that the taped end of the sample is printed first.

e. Print the sample at a printing pressure of 800 N and a printing speed of 1 m/s. Use 0.3 ml ink per sample, a distribution time of 30 seconds, and a printing form inking time of 30 seconds.

f. With the same printing disc, after a 10 second pause, print again. Please note the length of the pause may be adjusted to achieve desired pick. Do not clean the disc between printings.

g. After another pause of the same duration, print the sample again. The sample is either printed a certain number of times or until it begins to pick, in which case the number of impressions is noted.

h. The number of impressions that are made when picking occurs is noted. If picking does not occur on the last impression, the symbol>and the number of the last impression is noted. Note: through progressive drying on both the paper and the printing disc, the ink becomes tackier. The paper is then subject to increasing force from print to print. The more closed the coating is against the fluid portion of the ink (i.e., the slower the rise in the ink's viscosity), the more passes are possible before picking begins.

8. Print gloss—measured by producing an ink film on a sheet and allowing it to condition for 24 hours at 72° F.±5° F. and a relative humidity of 50%±5%. The gloss of the dried film is then measured using TAPPI test method T480 om-99.

9. Ink Density (at 15, 30, 45 or 60 seconds)—measured according to the procedure below.

a. Turn on Deltack Multipurpose Tack Measuring System b. Select and install carrier appropriate for sample caliper. Measure caliper in mm. of paper or paperboard using the micrometer.

c. Turn on computer.

d. In "Projects" folder, create a new folder for new project or choose existing folder for a continuing project. Leave file open.

e. Double click on Deltack icon.

f. Click "accept".

g. Select "Multiple Measurement" using either the "Measurement drop down" or the correct icon.

h. Click on "Deltack" tab. In "Parameters set" box, choose appropriate multiple measurement. Verify temperature and select appropriate printing speed (usually 1.0 m/s).

i. Click on "Measurement" tab. Set desired measurement interval time (usually 2). Select desired number of cycles (usually 30). Select measurement range (typically 100 mm-200 mm)

j. Click on "information" tab and enter pertinent information if applicable.

k. Click on "Auto Save" tab. Check "activ". In "Prefix" box type $ink$, $substrate$. In "Folder" box select the folder in which you want data saved.

l. Click on "deltack" tab to begin operation.

1. Mount a sample strip on the carrier.
2. Type in sample # in substrate box and ink ID in fluid box.
3. Apply desired amount of setting ink (about 0.15 ml.) to the distribution roller.
4. Turn on the distribution roller.
5. Ink the distribution roller for approximately 30 seconds.
6. Place the printing roller in contact with the distribution roller and ink the printing roller for approximately 30 seconds.
7. While wheel is inking, select "Start Measurement" on the Deltack screen.
8. Place inked wheel on desired Printing Unit. When using A unit the gap in the roller cover is placed at the 3 o'clock position. When using B unit the gap in the roller cover is placed at the 9 o'clock position. Make sure the wheel clicks in place.
9. Select "Start" to begin measurements.
10. When measurements are completed, select "End". This will automatically save the measurements. (If you do not want measurements saved, choose "abort".)
11. Clean the roller and the inking station. Using the same roller, move to the next inking station. Place the ink roller in contact with the distribution roller and allow it to dry for a minimum of 30 seconds, and then repeat the above steps.

m. Record data, e.g., sample ID, initial force (N), first minimum force (N), peak force (N), slope of regression line (best fit line) between first minimum and maximum force×100, and R2 value for regression line.

EXAMPLES

Examples 1-7 and Comparative Examples 1-6

Examples 1-7 were made according to the following procedure. In a continuous feed process, a reactor was initially charged with water, a portion of a copolymerizable surfactant and a metal chelating agent, e.g., a tetra sodium salt of ethylenediaminetetraacetic acid ("EDTA"). Additional water and a polymerization initiator, e.g., sodium persulfate, were then added to the reactor as an initiator feed over a four and a half hour time period. After adding the initiator feed to the reactor, an aqueous feed comprised of water, the balance of the copolymerizable surfactant and acrylic acid, if present in the formulations, were added to the reactor over a four hour time period. Simultaneously, a monomer feed was added to the reactor comprising monomers which react to form the copolymer. After the initiator, aqueous, and monomer feed were charged to the reactor, i.e. after 4.5 hours, the contents were neutralized by the addition of a base, e.g., ammonium hydroxide over a period of fifteen minutes. Finally an oxidizer feed, e.g., tert-butyl hydroperoxide ("TBHP") and a reducer feed, e.g., sodium metabisulfite ("SMBS"), were together provided to the reactor over a 1 hour time period.

For Examples 1 and 3, the amount of each component at each stage was as follows (on a per weight basis):

Initial reactor charge: 65 parts water, 0.03 parts EDTA, and 0.5 parts ADEKA REASOAP SR-10;

Initiator feed: 9.5 parts water and 0.25 parts sodium persulfate;

Aqueous feed: 33 parts water, 2.5 parts ADEKA REASOAP SR-10 and 3.0 parts acrylic acid;

Monomer feed: 39 parts MMA, and 55 parts BA;

Neutralization: 0.70 parts sodium hydroxide as 10%;

Oxidizer Feed: 0.3 parts TBHP; and

Reducer Feed: 0.29 parts SMBS.

Examples 1 and 3 resulted in a copolymer derived from 39 wt % MMA, 55 wt % BA, 3 wt % acrylic acid, and 3 wt % ADEKA REASOAP SR-10.

Examples 2 and 4 were prepared in the same manner as Examples 1 and 3 except that the monomer feed included 44 parts MMA and 50 parts BA resulting in a copolymer derived from 44 wt % MMA, 50 wt % BA, 3 wt % acrylic acid, and 3 wt % ADEKA REASOAP SR-10.

Examples 5 and 6 were prepared in the same manner as Examples 1 and 3 except that the initiator feed included 0.5 parts sodium persulfate, the aqueous feed included 2.5 parts acrylic acid, and the monomer feed included 55.5 parts BA. The resulting copolymer was derived from 39 wt % MMA, 55.5 wt % BA, 2.5 wt % acrylic acid, and 3 wt % ADEKA REASOAP SR-10.

Example 7 was prepared in the same manner as Examples 1 and 3 except that the initial reactor charge included 0.5 parts itaconic acid, the initiator feed included 0.5 parts sodium persulfate, the aqueous feed included 2.5 parts acrylic acid and 3 parts ADEKA REASOAP SR-10, and the monomer feed included 38.5 parts MMA and 55.5 parts BA. The resulting copolymer included 38.5 wt % MMA, 55 wt % BA, 2.5 wt % acrylic acid, 0.5 wt % itaconic acid and 3.5 wt % ADEKA REASOAP SR-10.

Comparative Examples 1-6 were made according to the same procedure as described above except that a non-polymerizable surfactant was used instead of the copolymerizable surfactant used in Examples 1-7.

Comparative Examples 1 and 2 are ACRONAL S 728, which is an aqueous dispersion of a styrene/n-butyl acrylate copolymer having a Tg of 23° C. and commercially available from BASF.

Comparative Examples 3 and 4 were prepared in the same general manner as Examples 1-7 except with the amount of each component at each stage provided below:

Initial reactor charge: 60 parts water, 0.03 parts EDTA, 0.5 parts of itaconic acid, and 0.9 parts of a polystyrene seed having a mean particle size of 28 nm;

Initiator feed: 19 parts water and 0.8 parts sodium persulfate;

Aqueous feed: 23 parts water, 0.8 parts Calfax DB 45 surfactant, and 3.0 parts acrylic acid;

Monomer feed: 41.5 parts MMA, and 55 parts BA;

Neutralization: 0.75 parts sodium hydroxide added as 10%;

Oxidizer Feed: 0.2 parts TBHP; and

Reducer Feed: 0.18 parts SMBS.

The resultant formulation for Comparative Examples 3 and 4 included a copolymer derived from 41.5 wt % MMA, 55 wt % BA and 3.5 wt % copolymerizable acids, and a total of 0.8 wt % of Calfax DB45 surfactant.

Comparative Examples 5 and 6 were made in the same manner as Comparative Examples 3 and 4 except that the monomer feed included 46.5% MMA and 50% BA to produce a copolymer derived from 46.5 wt % MMA, 50 wt % BA and 3.5 wt % copolymerizable acids.

Exemplary paper coating or binding formulations 1-7 were made by incorporating Examples 1-7, respectively, and comparative paper coating or binding formulations 1-6 were made by incorporating Comparative Examples 1-6, respectively, as discussed and shown in Table 1 below.

TABLE 1

| Ingredient | Activity % | Dry PPH |
|---|---|---|
| Pigment (Miragloss 91/Hydrocarb 90) | 100 | 100 (80/20) |
| Dispersant (Dispex N40) | 40 | 0.2 |
| Thickener (Sterocoll FS) | 40 | 0.2 |
| Lubricant (Calsan 50) | 50 | 1 |

MIRAGLOSS 91 is a kaolin clay coating pigment commercially available from BASF Corporation and HYDROCARB 90 is a calcium carbonate coating pigment commercially available from Omya Paper. DISPEX N40 is an acrylic dispersant commercially available from BASF Corporation.

For each of the formulations, the overall dry PPH was 12. In other words, the formulation included 12 parts by weight dry polymer per 100 parts per weight coating pigments and/or mineral fillers (Miragloss 91 and Hydrocarb 90). The coating solids % (wt/wt) was 65% for each of the formulations.

The viscosity (Brookfield Viscosity and Hercules Viscosity Apparent at Peak), AA-GWR, immobilization time, sheet gloss, IGT, print gloss, and Prufbau ink setting rate of each of comparative paper coating or binding formulations 1-6 and exemplary paper coating or binding formulations 1-7 were measured, and the results are shown in Table 2 below.

TABLE 2

| Paper Coating or Binding Formulation | | Comparative Formulation 1 | Comparative Formulation 2 | Comparative Formulation 3 |
|---|---|---|---|---|
| Brookfield Viscosity (cps) 100 rpm | | 1460 | 1450 | 2200 |
| Hercules Viscosity Apparent at Peak (cps) | | 21.7 | 21.4 | 42.2 |
| [a]AA-GWR ($g/m^2$) (2 ATM, 2 min) | | 112 | 111 | 113 |
| Immobilization Time (sec) | | 176 | 175 | 154 |
| Sheet Gloss | | 75.8 | 74.1 | 71.8 |
| [b]IGT (3 m/s) | | 209 | 205 | 116 |
| [b]IGT (2 m/s) | | 201 | 217 | 131 |
| Print Gloss | | 72.9 | 72.4 | 76.1 |
| [c]Ink Density Transfer to Blotter | 15 | 0.43 | 0.28 | 0.41 |
| after 15, 30, 45 and 60 sec of | 30 | 0.20 | 0.21 | 0.14 |
| Drying Time before Blotter | 45 | 0.09 | 0.04 | 0.05 |
| | 60 | 0.03 | 0.03 | 0.01 |

| Paper Coating or Binding Formulation | | Comparative Formulation 4 | Comparative Formulation 5 | Comparative Formulation 6 |
|---|---|---|---|---|
| Brookfield Viscosity (cps) 100 rpm | | 1740 | 2410 | 2350 |
| Hercules Viscosity Apparent at Peak (cps) | | 38.5 | 47.3 | 49.4 |
| AA-GWR ($g/m^2$) (2 ATM, 2 min) | | 112 | 118 | 115 |
| Immobilization Time (sec) | | 176 | 136 | 141 |
| Sheet Gloss | | 71.8 | 70.4 | 70.1 |
| IGT (3 m/s) | | 184 | 160 | 176 |
| IGT (2 m/s) | | 187 | 163 | 149 |
| Print Gloss | | 75.1 | 74.1 | 67.3 |
| Ink Density Transfer to Blotter | 15 | 0.44 | 0.36 | 0.23 |
| after 15, 30, 45 and 60 sec of | 30 | 0.19 | 0.17 | 0.07 |
| Drying Time before Blotter | 45 | 0.11 | 0.07 | 0.01 |
| | 60 | 0.07 | 0.02 | 0.01 |

| Paper Coating or Binding Formulation | | Exemplary Formulation 1 | Exemplary Formulation 2 | Exemplary Formulation 3 |
|---|---|---|---|---|
| Brookfield Viscosity (cps) 100 rpm | | 1420 | 1590 | 1240 |
| Hercules Viscosity Apparent at Peak (cps) | | 27.8 | 27.6 | 24.6 |
| AA-GWR ($g/m^2$) (2 ATM, 2 min) | | 82 | 96 | 91 |
| Immobilization Time (sec) | | 399 | 395 | 390 |
| Sheet Gloss | | 75.1 | 72.8 | 73.1 |
| IGT (3 m/s) | | 209 | 189 | 187 |
| IGT (2 m/s) | | 185 | 219 | 215 |
| Print Gloss | | 76.0 | 75.1 | 75.2 |
| Ink Density Transfer to Blotter | 15 | 0.69 | 0.63 | 0.61 |
| after 15, 30, 45 and 60 sec of | 30 | 0.28 | 0.34 | 0.31 |
| Drying Time before Blotter | 45 | 0.19 | 0.20 | 0.15 |
| | 60 | 0.08 | 0.11 | 0.04 |

| Paper Coating or Binding Formulation | | Exemplary Formulation 4 | Exemplary Formulation 5 | Exemplary Formulation 6 |
|---|---|---|---|---|
| Brookfield Viscosity (cps) 100 rpm | | 1550 | 1530 | 1370 |
| Hercules Viscosity Apparent at Peak (cps) | | 25.8 | 28.6 | 25.6 |
| AA-GWR ($g/m^2$) (2 ATM, 2 min) | | 92 | 83 | 86 |
| Immobilization Time (sec) | | 334 | 405 | 387 |
| Sheet Gloss | | 72.8 | 73.2 | 73.1 |
| IGT (3 m/s) | | 235 | 189 | 205 |
| IGT (2 m/s) | | 219 | 201 | 201 |
| Print Gloss | | 74.3 | 75.0 | 74.6 |
| Ink Density Transfer to Blotter | 15 | 0.58 | 0.63 | 0.72 |
| after 15, 30, 45 and 60 sec of | 30 | 0.29 | 0.28 | 0.34 |
| Drying Time before Blotter | 45 | 0.14 | 0.12 | 0.16 |
| | 60 | 0.04 | 0.06 | 0.10 |

| Paper Coating or Binding Formulation | Exemplary Formulation 7 |
|---|---|
| Brookfield Viscosity (cps) 100 rpm | 2030 |
| Hercules Viscosity Apparent at Peak (cps) | 32.1 |
| AA-GWR ($g/m^2$) (2 ATM, 2 min) | 77 |
| Immobilization Time (sec) | 481 |
| Sheet Gloss | 73.5 |
| IGT (3 m/s) | 203 |
| IGT (2 m/s) | 202 |
| Print Gloss | 77.2 |

TABLE 2-continued

| | | |
|---|---|---|
| Ink Density Transfer to Blotter | 15 | 0.64 |
| after 15, 30, 45 and 60 sec of | 30 | 0.45 |
| Drying Time before Blotter | 45 | 0.22 |
| | 60 | 0.18 |

[a]AA-GWR value is a measure of water retention capacity of a coating or binding formulation under pressure. High AA-GWR values are indicative of low water retention capacity which may lead to poor runnability.
[b]IGT, aka dry pick resistance, measures the ability of a paper surface to accept transfer of ink without picking.
[c]Ink setting measures the rate of ink setting and a low number indicates too fast an ink setting rate.

Examples 8-16 and Comparative Examples 7-12

Examples 8, 11 and 14 were made in the same manner described for Example 7.

Examples 9, 12 and 15 were made in generally the same manner described in Example 1. In these examples, the amount of each component at each stage was as follows (on a per weight basis):

Initial reactor charge: 65 parts water, 0.03 parts EDTA, and 0.5 parts ADEKA REASOAP SR-10;

Initiator feed: 9.5 parts water and 0.5 parts sodium persulfate;

Aqueous feed: 35 parts water, 3.0 parts ADEKA REASOAP SR-10, 2.5 parts acrylic acid and 0.5 parts itaconic acid;

Monomer feed: 38.5 parts MMA, and 55 parts BA;

Neutralization: 0.75 parts sodium hydroxide (10%);

Oxidizer Feed: 0.219 parts TBHP; and

Reducer Feed: 0.219 parts SMBS.

Examples 9, 12 and 15 resulted in a copolymer derived from 38.5 wt % MMA, 55 wt % BA, 2.5 wt % acrylic acid, 0.5 wt % itaconic acid, and 3.5 wt % ADEKA REASOAP SR-10.

Examples 10, 13 and 16 were similar to Examples 9, 12 and 15 except the monomer feed included 43.5 parts MMA and 50 parts BA resulting in a copolymer derived from 43.5 wt % MMA, 50 wt % BA, 2.5 wt % acrylic acid, 0.5 wt % itaconic acid, and 3.5 wt % ADEKA REAS OAP SR-10.

Comparative Examples 7, 9 and 11 were STYRONAL BN 4606, an aqueous dispersion of a carboxylated styrene butadiene copolymer having a Tg of 6° C., commercially available from BASF Corpoation.

Comparative Examples 8, 10 and 12 were ACRONAL S 504, an aqueous dispersion of n-butyl-acrylate-acrylonitrile-styrene copolymer having a Tg of 4° C., commercially available from BASF Corpoation.

Comparative paper coating or binding formulations 7-12 were made by incorporating Comparative Examples 7-12, respectively, and exemplary paper coating or binding formulations 8-16 were made by incorporating Examples 8-16, respectively, as shown in Tables 3-4 below.

TABLE 3

| Ingredient | Activity % | Dry PPH |
|---|---|---|
| Pigment (Miragloss 91/Hydrocarb 90) | 100 | 100 (40/60) |
| Dispersant (Dispex N40) | 40 | 0.2 |
| Thickener (Sterocoll FS) | 40 | 0.2 |
| Lubricant (Calsan 50) | 50 | 0.9 |

TABLE 4

| Dispersion | Activity % | Dry PPH[d] | Coat Wt. g/m$^2$ | Coating Solids % w/w |
|---|---|---|---|---|
| Comparative Formulation 7 | 50.2 | 14 | 10.4 | 62 |
| Comparative Formulation 8 | 50.5 | 14 | 10.4 | 62 |
| Exemplary Formulation 8 | 43.5 | 14 | 10.4 | 62 |
| Exemplary Formulation 9 | 48.8 | 14 | 10.4 | 62 |
| Exemplary Formulation 10 | 48 | 14 | 10.4 | 62 |
| Comparative Formulation 9 | 50.2 | 14 | 10.4 | 64 |
| Comparative Formulation 10 | 50.5 | 14 | 10.4 | 64 |
| Exemplary Formulation 11 | 43.5 | 14 | 10.4 | 64 |
| Exemplary Formulation 12 | 48.8 | 14 | 10.4 | 64 |
| Exemplary Formulation 13 | 48 | 14 | 10.4 | 64 |
| Comparative Formulation 11 | 50.2 | 14 | 10.4 | 66 |
| Comparative Formulation 12 | 50.5 | 14 | 10.4 | 66 |
| Exemplary Formulation 14 | 43.5 | 14 | 10.4 | 66 |
| Exemplary Formulation 15 | 48.8 | 14 | 10.4 | 66 |
| Exemplary Formulation 16 | 48 | 14 | 10.4 | 66 |

[d]As noted earlier, this corresponds to the amount of dry polymer in parts per weight per 100 parts per weight of the coating pigments and/or mineral fillers.

The viscosity (Brookfield Viscosity and Hercules Viscosity Apparent at Peak), AA-GWR, and immobilization time, of each of comparative paper coating or binding formulations 7-12 and exemplary paper coating or binding formulations 8-16 were measured. The sheet gloss, print gloss, and Prufbau Passes to Fail where measured for comparative formulations 11-12 and exemplary paper coating or binding formulations 14-16. The results are shown in Table 5 below.

TABLE 5

| Paper Coating or Binding Formulation | Comparative Formulation 7 | Comparative Formulation 8 | Exemplary Formulation 8 |
|---|---|---|---|
| Brookfield Viscosity (cps) 100 rpm | 680 | 848 | 780 |
| Hercules Viscosity Apparent at Peak (cps) | 19.2 | 27.7 | 23.8 |
| AA-GWR ($g/m^2$) (2 ATM, 2 min) | 155 | 149 | 99 |
| Immobilization Time (sec) | 214 | 212 | 673 |

| Paper Coating or Binding Formulation | Exemplary Formulation 9 | Exemplary Formulation 10 |
|---|---|---|
| Brookfield Viscosity (cps) 100 rpm | 840 | 924 |
| Hercules Viscosity Apparent at Peak (cps) | 26.1 | 22.6 |
| AA-GWR ($g/m^2$) (2 ATM, 2 min) | 100 | 102 |
| Immobilization Time (sec) | 575 | 574 |

| Paper Coating or Binding Formulation | Comparative Formulation 9 | Comparative Formulation 10 | Exemplary Formulation 11 |
|---|---|---|---|
| Brookfield Viscosity (cps) 100 rpm | 1070 | 1152 | 1196 |
| Hercules Viscosity Apparent at Peak (cps) | 24.6 | 33.2 | 24.9 |
| AA-GWR ($g/m^2$) (2 ATM, 2 min) | 135 | 139 | 89 |
| Immobilization Time (sec) | 215 | 201 | 655 |

| Paper Coating or Binding Formulation | Exemplary Formulation 12 | Exemplary Formulation 13 |
|---|---|---|
| Brookfield Viscosity (cps) 100 rpm | 1368 | 1644 |
| Hercules Viscosity Apparent at Peak (cps) | 33.6 | 39.1 |
| AA-GWR ($g/m^2$) (2 ATM, 2 min) | 96 | 91 |
| Immobilization Time (sec) | 524 | 536 |

| Paper Coating or Binding Formulation | Comparative Formulation 11 | Comparative Formulation 12 | Exemplary Formulation 14 |
|---|---|---|---|
| Brookfield Viscosity (cps) 100 rpm | 1528 | 2248 | 1680 |
| Hercules Viscosity Apparent at Peak (cps) | 28.6 | 42.7 | 28.2 |
| AA-GWR ($g/m^2$) (2 ATM, 2 min) | 134 | 131 | 87 |
| Immobilization Time (sec) | 175 | 135 | 507 |
| Sheet Gloss | 68.1 | 68.0 | 63.7 |
| Print Gloss | 72.4 | 74.1 | 74.2 |
| Prufbau Passes to Fail | 6 | 6 | 9 |

| Paper Coating or Binding Formulation | Exemplary Formulation 15 | Exemplary Formulation 16 |
|---|---|---|
| Brookfield Viscosity (cps) 100 rpm | 1948 | 2120 |
| Hercules Viscosity Apparent at Peak (cps) | 39.3 | 47.1 |
| AA-GWR ($g/m^2$) (2 ATM, 2 min) | 89 | 97 |
| Immobilization Time (sec) | 430 | 446 |
| Sheet Gloss | 61.4 | 63.8 |
| Print Gloss | 72.5 | 73.5 |
| Prufbau Passes to Fail | 7 | 7 |

Examples 17-24 and Comparative Examples 13-16

Copolymer dispersion A was made in generally the same manner described in Example 1 and the amount of each component at each stage was as follows (on a per weight basis):

Initial reactor charge: 75 parts water, 0.03 parts EDTA, 0.5 parts ADEKA REASOAP SR-10, and 0.5 pts itaconic acid;

Initiator feed: 19 parts water and 1.0 parts sodium persulfate;

Aqueous feed: 25 parts water, 2.5 parts ADEKA REASOAP SR-10, and 3.0 parts acrylic acid;

Monomer feed: 58.5 parts styrene, 38 parts butadiene and 0.8 pts of SULFOLE 120 (t-dodecyl mercaptan);

Neutralization: 0.8 parts sodium hydroxide (10%);

Oxidizer Feed: 0.2 parts TBHP; and

Reducer Feed: 0.19 parts SMBS.

The resultant Copolymer A dispersion included a copolymer derived from 56.8 wt % styrene, 36.9 wt. % butadiene, 2.9 wt % acrylic acid, 0.5% itaconic acid, and 2.9 wt % ADEKA REAS OAP SR-10.

Examples 17, 19, 21 and 23 included a blend of 50/50 weight ratio blend of the Copolymer A dispersion and STYRONAL BN 4606. Examples 18, 20, 22 and 24 included only the Copolymer A dispersion. Comparative Examples 13-16 included only STYRONAL BN 4606. Exemplary paper coating or binding formulations 17-24, respectively, were made from Examples 17-24, respectively, and comparative paper coating or binding formulations 13-16, respectively, were made from comparative examples 13-16, respectively, as discussed and shown in Table 6 below.

TABLE 6

| Ingredient | Activity % | Dry PPH |
|---|---|---|
| Pigment (Miragloss 91/Hydrocarb 90) | 100 | 100 (80/20) |
| Dispersant (Dispex N40) | 40 | 0.3 |
| Lubricant (Calsan 50) | 50 | 1 |

For each of the formulations, the overall dry PPH was 12. The coating solids % (wt/wt) was 69% for comparative formulation 13 and exemplary formulations 17-18, 67% for comparative formulation 14 and exemplary formulations 19-20, 65% for comparative formulation 15 and exemplary formulations 21-22, and 63% for comparative formulation 16 and exemplary formulations 23-24.

The viscosity (Brookfield Viscosity and Hercules Viscosity Apparent at Peak), AA-GWR, and immobilization time of each of comparative paper coating or binding formulations 13-16 and exemplary paper coating or binding formulations 17-24 were measured, and the results are shown in Table 7 below.

TABLE 7

| Paper Coating or Binding Formulation | Comparative Formulation 13 | Exemplary Formulation 17 | Exemplary Formulation 18 |
|---|---|---|---|
| Brookfield Viscosity (cps) 100 rpm | 5460 | 4170 | 3150 |
| Hercules Viscosity Apparent at Peak (cps) | 44.5 | 32.2 | 18.4 |
| AA-GWR ($g/m^2$) (2 ATM, 2 min) | 103 | 91 | 78 |
| Immobilization Time (sec) | 48 | 102 | 134 |
| **Paper Coating or Binding Formulation** | **Comparative Formulation 14** | **Exemplary Formulation 19** | **Exemplary Formulation 20** |
| Brookfield Viscosity (cps) 100 rpm | 3030 | 2860 | 2230 |
| Hercules Viscosity Apparent at Peak (cps) | 38.6 | 23.0 | 22.4 |
| AA-GWR ($g/m^2$) (2 ATM, 2 min) | 116 | 98 | 98 |
| Immobilization Time (sec) | 73 | 144 | 195 |
| **Paper Coating or Binding Formulation** | **Comparative Formulation 15** | **Exemplary Formulation 21** | **Exemplary Formulation 22** |
| Brookfield Viscosity (cps) 100 rpm | 1740 | 1760 | 1440 |
| Hercules Viscosity Apparent at Peak (cps) | 25.7 | 20.6 | 19.1 |
| AA-GWR ($g/m^2$) (2 ATM, 2 min) | 135 | 112 | 126 |
| Immobilization Time (sec) | 116 | 202 | 244 |
| **Paper Coating or Binding Formulation** | **Comparative Formulation 16** | **Exemplary Formulation 23** | **Exemplary Formulation 24** |
| Brookfield Viscosity (cps) 100 rpm | 1450 | 1300 | 1070 |
| Hercules Viscosity Apparent at Peak (cps) | 20.0 | 17.1 | 15.2 |
| AA-GWR ($g/m^2$) (2 ATM, 2 min) | 142 | 123 | 116 |
| Immobilization Time (sec) | 136 | 242 | 300 |

The compositions and methods described herein are not limited in scope by the embodiments disclosed herein which are intended as illustrations of a few aspects of the compositions and methods and any embodiments which are functionally equivalent are within the scope of the claims. Various modifications of the compositions and methods in addition to those shown and described herein will become apparent to those skilled in the art and are intended to fall within the scope of the appended claims. Further, while only certain representative combinations of monomers used to make a composition or method steps disclosed herein are specifically discussed in the embodiments above, other combinations of monomers used to make a composition or method steps will become apparent to those skilled in the art and also are intended to fall within the scope of the appended claims. The term "comprising" and variations thereof as used herein is used synonymously with the term "including" and variations thereof and are open, non-limiting terms. Although the terms "comprising" and "including" have been used herein to describe various embodiments, the terms "consisting essentially of" and "consisting of" can be used in place of "comprising" and "including" to provide for more specific embodiments of the invention and are also disclosed.

This application claims priority from U.S. provisional application No. 61/316,488, incorporated herein by reference.

What is claimed is:

1. Paper comprising a fiber matrix and a coating or binding composition comprising:

a vinyl acrylic-based copolymer derived from:

one or more monomers, the one or more monomers including a vinyl ester of a C1-C18 mono- or dicarboxylic acid; and at least one copolymerizable surfactant of formula I, or salt thereof:

(I)

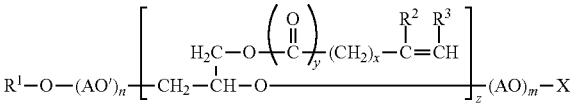

wherein $R^1$ represents a branched aliphatic hydrocarbon group, a secondary aliphatic hydrocarbon group or a branched aliphatic acyl group, AO and AO' each independently represents an oxyalkylene group having 2 to 4 carbon atoms, $R^2$ and $R^3$ each independently represents a hydrogen atom or a methyl group, x stands for a number of from 0 to 12, y stands for a number of 0 to 1, z stands for a number of from 1 to 10, X represents a hydrogen atom or an ionic hydrophilic group, m stands for a number of from 0 to 1,000, and n stands for a number of from 0 to 1,000; and one or more mineral fillers, coating pigments, or mixtures thereof, wherein the total weight concentration of the one or more mineral fillers, coating pigments, or mixtures thereof is 65% or higher, based on the total weight of the composition.

2. The paper according to claim 1, further comprising one or more thickeners or dispersants.

3. The paper according to claim 1, wherein the one or more monomers are selected from the group consisting of styrene, butadiene, vinyl acetate, carboxylic acids, (meth)acrylic acid esters, (meth)acrylamide, and (meth)acrylonitrile.

4. The paper according to claim 1, wherein at least one of the one or more monomers is selected from the group consisting of (meth)acrylic acid, (meth)acrylic acid esters, (meth)acrylamide, (meth)acrylonitrile, and mixtures thereof.

5. The paper according to claim 4, wherein the copolymer is derived from:

39 to 79% by weight of a first (meth)acrylic acid ester;

20 to 60% by weight of a second (meth)acrylic acid ester;

0.5 to 5% by weight of the at least one copolymerizable surfactant;

0.5 to 6% by weight of itaconic acid or a (meth)acrylic acid;

0 to 3% by weight of at least one (meth)acrylamide; and 0 to 20% by weight of at least one (meth)acrylonitrile.

6. The paper according to claim 4, wherein the one or more monomers comprise two or more of methyl methacrylate, 2-ethyl hexyl acrylate, and butyl acrylate.

7. The paper according to claim 6, wherein the one or more monomers further comprise acrylic acid.

8. The paper according to claim 1, wherein the copolymerizable surfactant is of formula Ia:

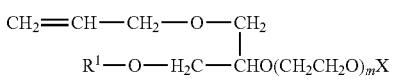

(Ia)

wherein $R^1$ is C9-C15 alkyl or C7-C11 alkyl-phenyl, X is H, $SO_3NH_4$ and/or $SO_3Na$, and m is 3 to 50.

9. The paper according to claim 8, wherein $R^1$ is C10-C14 alkyl and m is from 5 to 25.

10. The paper according to claim 1, wherein the composition is substantially free of non-copolymerizable surfactants.

11. The paper according to claim 1, wherein the copolymer has a glass transition temperature of −10° C. to 25° C.

12. A method of making paper, comprising:

forming a fiber matrix;

impregnating the fiber matrix with a coating or binding composition comprising an aqueous dispersion comprising a vinyl acrylic-based copolymer derived from:

one or more monomers, the one or more monomers including a vinyl ester of a C1-C18 mono- or dicarboxylic acid; and at least one copolymerizable surfactant of formula I, or salt thereof:

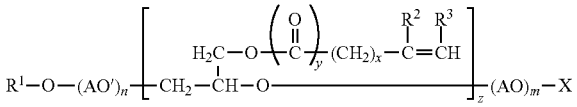

(I)

wherein $R^1$ represents a branched aliphatic hydrocarbon group, a secondary aliphatic hydrocarbon group or a branched aliphatic acyl group, AO and AO' each independently represents an oxyalkylene group having 2 to 4 carbon atoms, $R^2$ and $R^3$ each independently represents a hydrogen atom or a methyl group, x stands for a number of from 0 to 12, y stands for a number of 0 to 1, z stands for a number of from 1 to 10, X represents a hydrogen atom or an ionic hydrophilic group, m stands for a number of from 0 to 1,000, and n stands for a number of from 0 to 1,000; and one or more mineral fillers, coating pigments, or mixtures thereof, wherein the total weight concentration of the one or more mineral fillers, coating pigments, or mixtures thereof is 65% or higher, based on the total weight of the composition; and drying the impregnated fiber matrix to produce the paper.

13. The method according to claim 12, wherein the composition is provided in an amount from 7 g/m$^2$ to 20 g/m$^2$ per 150 g/m$^2$ of paper.

14. The method according to claim 12, wherein the composition has a water retention capacity of 100 g/m or less, as measured when applied to paper.

15. The method according to claim 12, wherein the composition has an immobilization time of 300 seconds or longer.

* * * * *